US005452832A

United States Patent [19]

Niada

[11] Patent Number: 5,452,832

[45] Date of Patent: Sep. 26, 1995

[54] AUTOMATIC DISPENSER FOR PAPER TOWELS SEVERABLE FROM A CONTINUOUS ROLL

[75] Inventor: Gianandrea Niada, Milan, Italy

[73] Assignee: QTS S.r.l., Milan, Italy

[21] Appl. No.: 152,652

[22] Filed: Nov. 15, 1993

Related U.S. Application Data

[63] Continuation-in-part of Ser. No. 43,420, Apr. 6, 1993, abandoned.

[51] Int. Cl.[6] ..... A47K 10/36; B65H 35/04

[52] U.S. Cl. ..... 225/11; 225/8; 225/10; 225/47; 242/564.1; 242/564.4

[58] Field of Search ..... 225/8, 10, 11, 225/15, 19, 23, 39, 42, 46, 47, 106; 242/564.1, 564.3, 564.4; 221/13

[56] References Cited

U.S. PATENT DOCUMENTS

| | | | |
|---|---|---|---|
| 2,215,052 | 9/1940 | Price et al. . | |
| 2,839,345 | 6/1958 | Engel et al. | 312/39 |
| 3,297,269 | 1/1967 | McGrew | 242/55.53 |
| 3,730,409 | 5/1973 | Ratti | 225/14 |
| 4,119,255 | 10/1978 | D'Angelo | 226/136 |
| 4,358,169 | 11/1982 | Filipowicz et al. | 312/39 |
| 4,666,099 | 5/1987 | Hoffman et al. | 242/55.53 |
| 4,790,490 | 12/1988 | Chakravorty | 242/564.1 |

FOREIGN PATENT DOCUMENTS

| | | |
|---|---|---|
| 0235438 | 9/1987 | European Pat. Off. . |
| 105784 | 12/1988 | Taiwan, Prov. of China . |

*Primary Examiner*—Eugenia Jones
*Attorney, Agent, or Firm*—Panitch Schwarze Jacobs & Nadel

[57] ABSTRACT

An automatic dispenser for paper towels shaped in strips of an appropriate length severable from a continuous feed roll, outputs a portion of paper of an appropriate length cutting it with a stationary blade. The blade is located in a less accessible area of the apparatus for user safety reasons. Dispensing is usually controlled by a photoelectric cell or proximity detector, which actuates an ON-OFF switch for supplying power to a motor during a time period predetermined by a timer, thereby causing rotation of a dragging roller adapted to cause a certain extent of unrolling of the feed roll. In case of saturation of the photoelectric cell caused by improperly keeping it intercepted, an electronic switch disables the photo cell and enables an emergency push-button while also lighting a signal lamp to advise of a change in the operating condition, which requires a push of an emergency button.

7 Claims, 5 Drawing Sheets

45b
41b
43b
IV
II
II
16
19
31
III
III
5
IV
13
25
7a
12
1
45a
43a
41a

AUTOMATIC DISPENSER FOR PAPER TOWELS SEVERABLE FROM A CONTINUOUS ROLL

CROSS-REFERENCE TO RELATED APPLICATION

This is a continuation-in-part of application Ser. No. 08/043,420, filed Apr. 6, 1993 now abandoned.

BACKGROUND OF THE INVENTION

1. Field of the Invention

This invention concerns an automatic dispenser for paper towels which are severable from a continuous roll in the shape of predetermined length strips made available on the outside of the dispensing apparatus so that they can be subsequently torn off manually against a stationary blade located in a relatively hidden position within the device.

A number of types of paper towel dispensers are already known, adapted in particular to enable a manual pulling of the free flap which has remained accessible after a previous usage, and the "ripping" thereof against a stationary blade. A brake device is sometimes provided which is adapted to block the unwinding of the strip from the feed roll, after a certain length, thereby making it easier to tear off the paper to be used, whereafter a further clean flap of material may be allowed to project outside to be manually grabbed for a subsequent usage cycle. In other embodiments, a side crank or handle is provided for rotating the feed roll in the unwinding direction, in order to have available on the outside a paper strip of a desired length.

In any case, actuation is generally manual, while motorized actuation is usually a feature of fabric towel dispensers, where the higher cost caused by automatic controls and motor actuation seems to be justified by the different properties of the material, which is substantially reusable and lasts longer.

2. Description of the Prior Art

However U.S. Pat. No. 4,666,099 discloses an automatic dispenser for paper towels which, when activated in response to the proximity of a portion of a user's hand without the need of contacting the apparatus, dispenses a predetermined length of sheet material from a supplying roll of material by means of an electrical motor operating for a predetermined time.

Furthermore U.S. Pat. No. 2,839,345, with reference to another dispenser apparatus, although manually operated by means of a crank, discloses the presence of a re-setting button which is connected to a feed-limiting mechanism preventing a continued rotation of the crank, whereby only by pressing said button the mechanism is released and another portion of paper web can be dispensed, corresponding to the allowed rotation of the crank. To avoid a misuse of the apparatus the re-setting button is concealed from the view until the user has torn off across a knife the length of web originally dispensed and the button is exposed to be pressed again, thus causing the device to be in condition for operation. With this arrangement the knife or cutting blade is mounted on a lower portion of the housing in a position set back within the dispensing port.

It is also known from the prior part (e.g. U.S. Pat. No. 4,666,099) to use a photoelectric cell to control the dispensing motor. Also providing two separate means, such as a photocell and a push-button, for actuating the apparatus, thus allowing the operator to select which means to use, could be known or obvious to one having ordinary skill in the art.

However it is not really practicable to provide on the apparatus a means such as a selector in order that a user can choose at will the type of operation to be adopted, for both reasons of avoiding that a rather delicate device is made available to the public and subject to improper operations, and owing to the natural reluctance, from the users themselves, to contact with their own hands, often dripping or wet, parts of the apparatus already touched by other persons and possibly still carrying traces of water left by a previous user.

Furthermore it is preferable that the dispenser is usually operated by means of a photoelectric cell or proximity detector, except in case of failure thereof (e.g. owing to a possible misuse, like sticking on the photocell or anything that can intercept its light beam) where a subsequent user may be unaware of the situation and unable to operate the dispenser.

SUMMARY OF THE INVENTION

An object of the invention is to provide an apparatus for dispensing paper towels severable from a continuous roll for a predetermined, adjustable length by operating a motor for a predetermined length of time, on actuation by a photoelectric cell or proximity detector during normal operation and, upon saturation or failure for any reason of the photocell, by an emergency push-button switch.

Another object of the invention is to provide an apparatus of the above-mentioned type having a cover and an electric contact co-operating with said cover to disable the photocell control and enable the emergency push-button upon opening of the cover itself.

These objects are obtained by providing an electronic switch which is normally connecting the power supply to an ON-OFF photocell main circuit and, in response to a saturation or generally an inhibited operation of the photocell, is switched to feed the power supply to an emergency push-button switch which is connected, in parallel with said ON-OFF photocell main circuit, to an ON-OFF motor control.

In a preferred embodiment of the invention an auxiliary safety switch is provided on the cover of the dispenser apparatus to cause, upon opening of the cover, said electronic switch to close the circuit on the emergency push-button only.

BRIEF DESCRIPTION OF THE DRAWINGS

The above and other objects, advantages and features of the dispensing apparatus according to this invention will become more apparent from the following detailed description of a preferred embodiment thereof, which is given herein for exemplary and non limiting purposes, reference being made to the attached drawings, wherein:

FIG. 3 shows another cross section along line III—III of FIG. 1, with a paper feed roll mounted therewithin, in order to show the paper path all the way to the outlet opening and further on;

DESCRIPTION OF THE INVENTION

Figure 1:
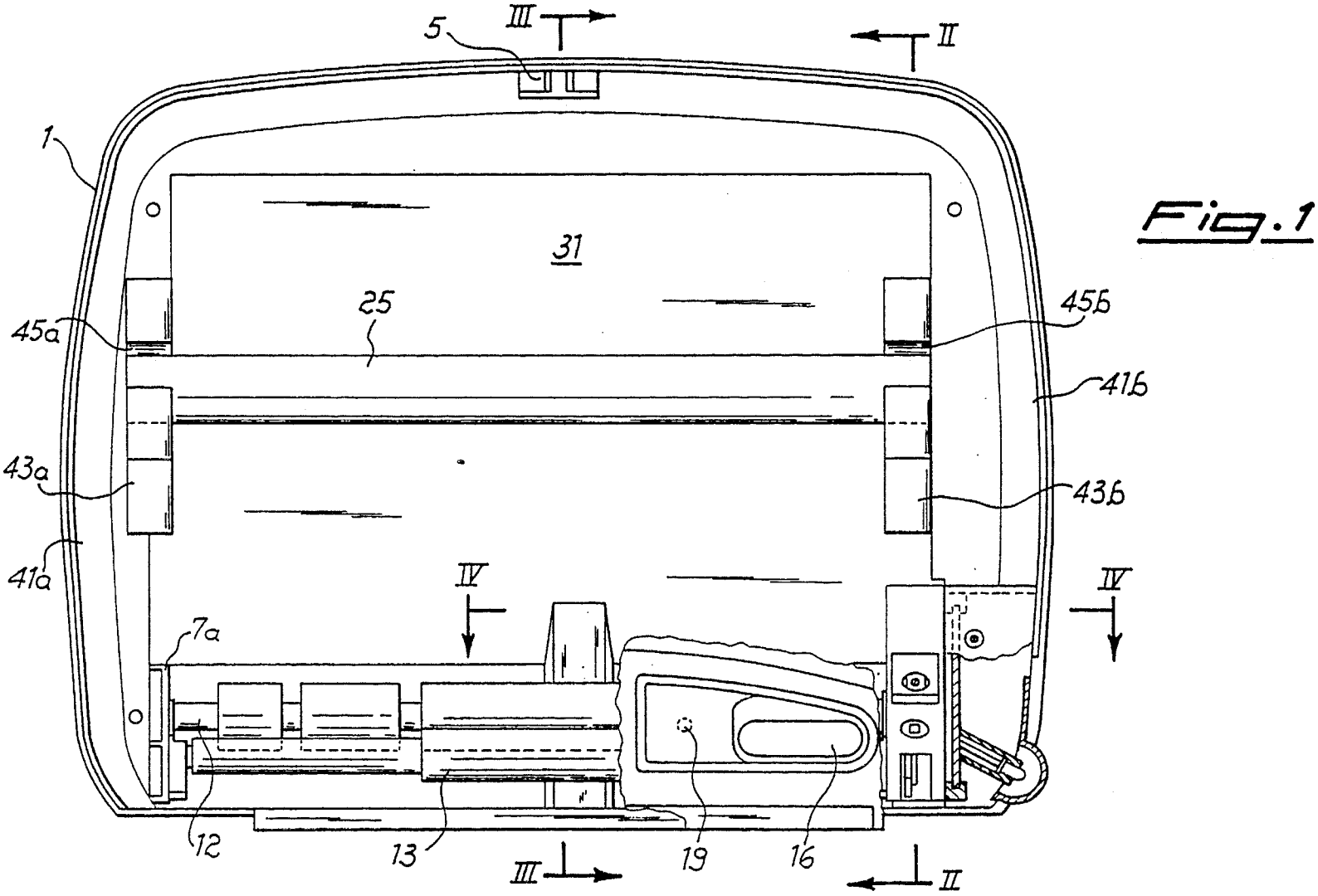
FIG. 1 shows a front view of the device support portion only, with the cover substantially taken off, except for a portion of the right-hand low zone thereof.
Figure 2:
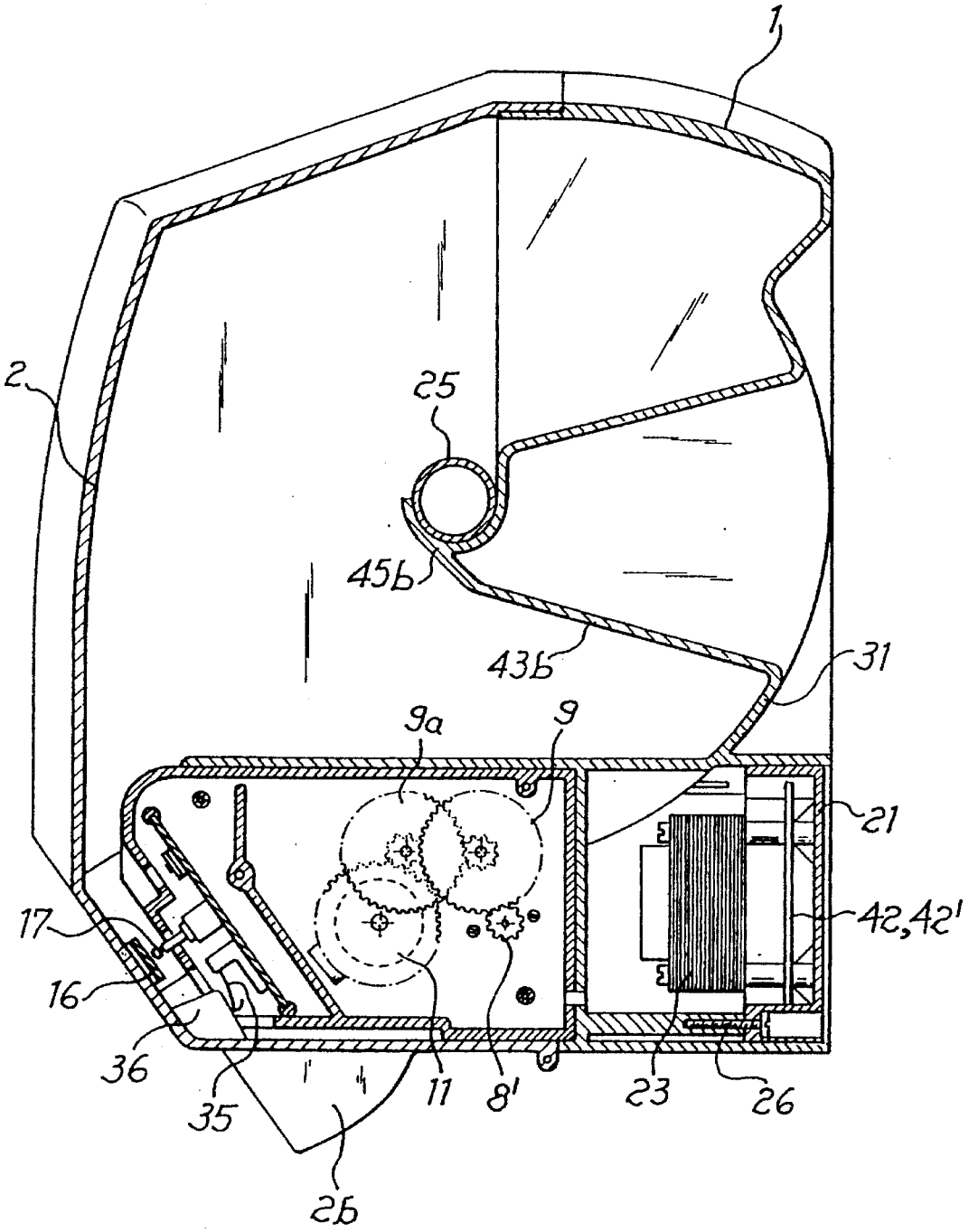
FIG. 2 shows a cross-sectional view along line II—II of FIG. 1.
Figure 3:
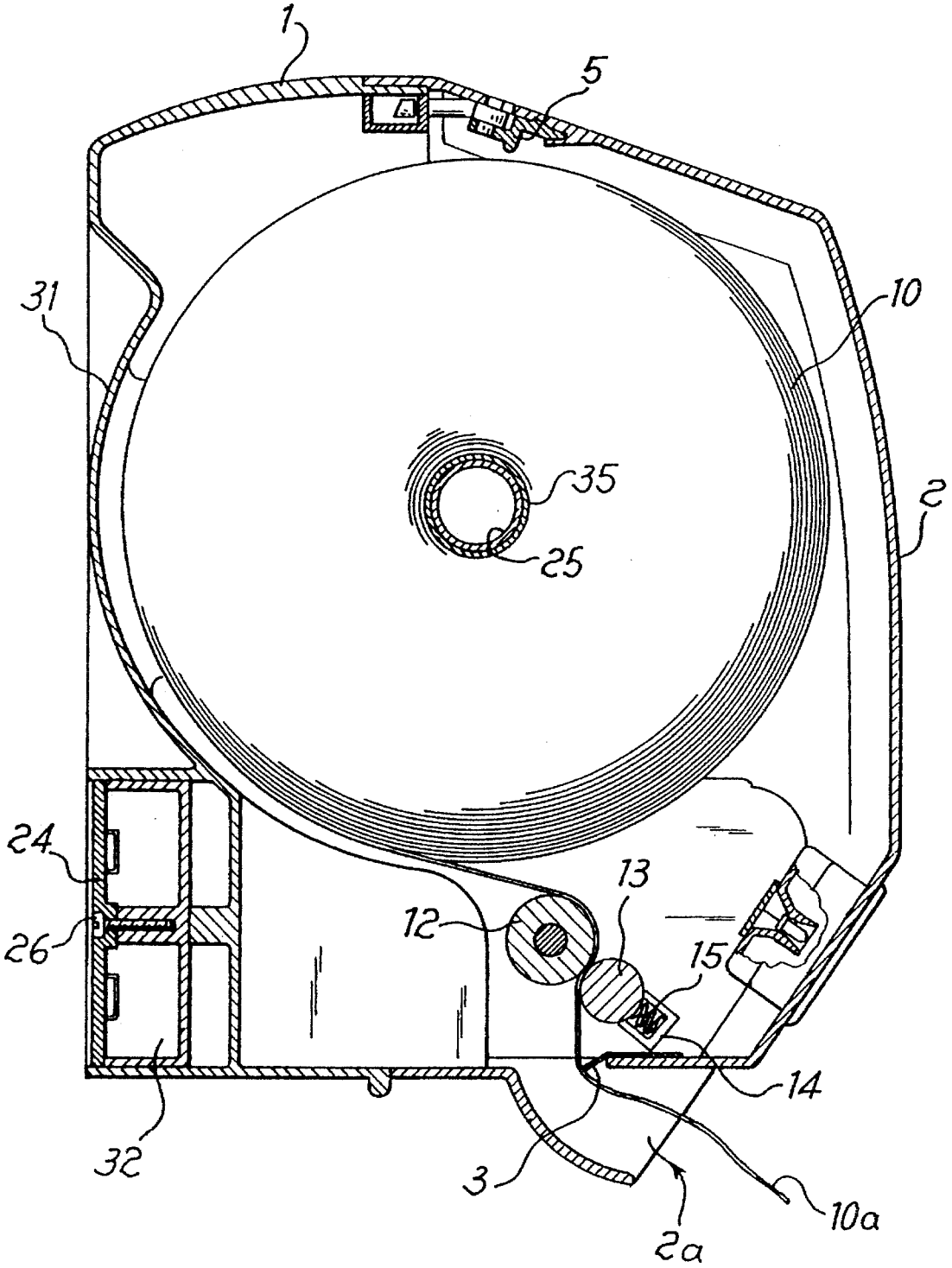

Referring now to the drawings, the inventive device includes a housing thereof comprising a wall mounted support portion 1 having a back portion 31 adapted to be fastened to a wall, two side walls 41*a* and 4l*b* and a paper feed roll support comprising a pair of bracket or cantilever members 43*a*, 43*b*, having a substantially semi-circular recess 45*a*, 45*b* adapted to provide a rolling engagement seat for the ends of a tubular member 25 used as a core for roll 10. A cover 2 is hingedly connected to a lower portion of the housing, being securable to the support 1 by means of an upper lock 5, and has a downwards facing paper dispensing port 2*a*, directed in such a way as to provide a guiding action for a flaps of paper 10*a* towards the outside, after the paper has passed in front of a cutting blade 3 mounted on cover 2 in a position set back within the recess defined by port 2*a*, in order to be scarcely accessible from outside. As it is shown more clearly in FIG. 2, said recess is protected also on the sides, at both ends of dispensing port 2*a*, by a pair of walls 2*b* integral with cover 2 as well. In this way accessibility to blade 3 from the outside is reduced to a minimum. Note that no accessibility is required in this case, as there is made available on the outside a flaps of paper 10*a* having a length sufficient for use and thereafter tearing it off by applying a pressure on said blade 3 without having to grab the flap of paper 10*a* close to the blade 3.

Paper dispensing is performed by dragging the paper by means of a dragging roller 12 actuated by a small motor 8 (FIG. 4) fastened to support portion 1, in particular on an internal side shoulder 7 thereof. Referring now to the drawings (FIG. 2), a pinion 8' on the motor output shaft meshes with a first gear 9 of a reduction gear whose second gear 9*a* meshes in turn with a further motion transmitting gear 11 mounted on roller 12 shaft.

Figure 4:
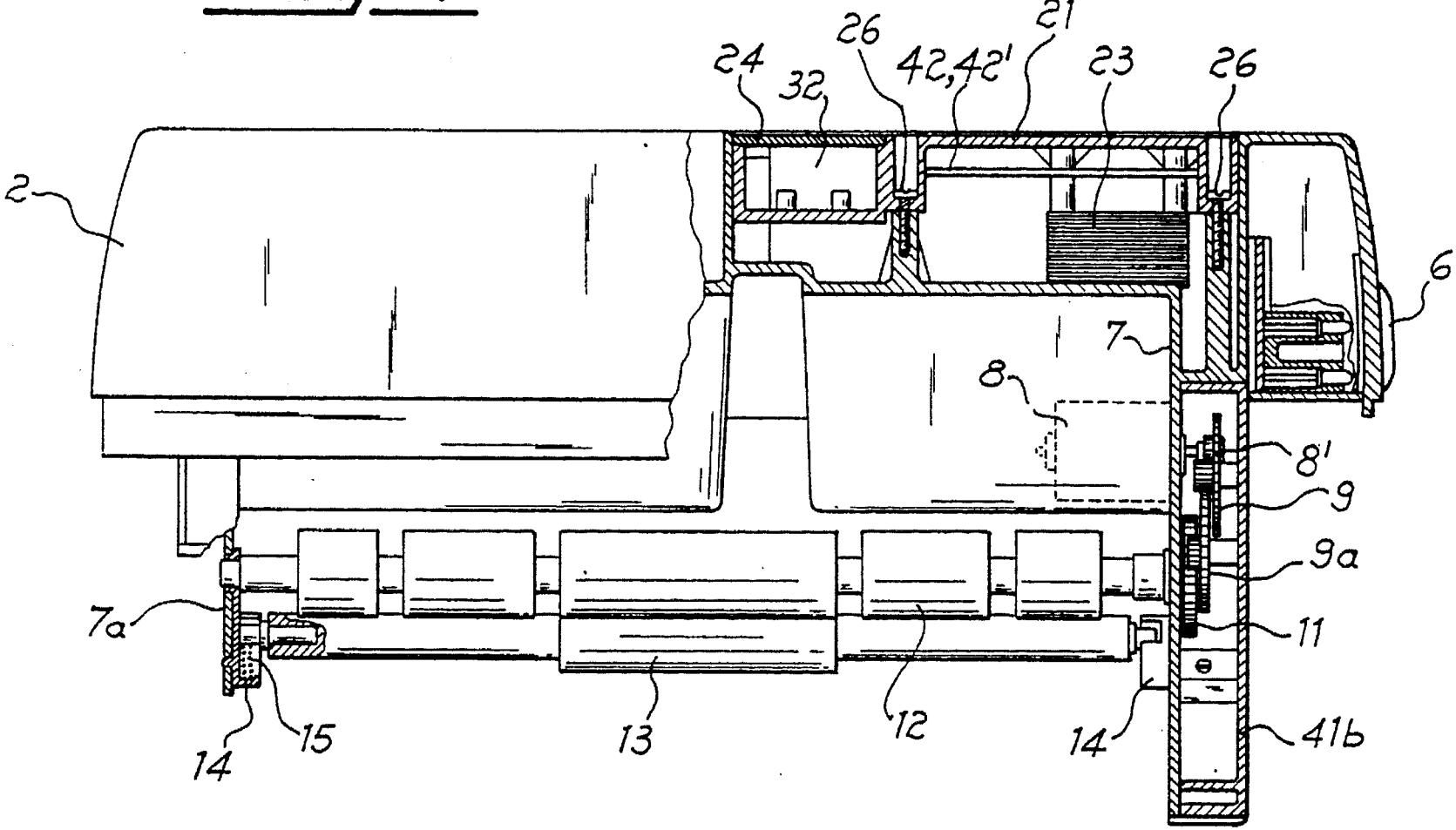
FIG. 4 shows a top plan view of said apparatus, without the cover and in partial cross section, along line IV—IV of FIG. 1.

Paper 10*a* coming from roll 10 is led between the surface of roller 12 and a confronting, pressure roller 13 rotatingly mounted for instance on a pair of journals fastened to the ends thereof, each of them being rotatable within a small support plate 14 provided with biasing springs 15 adapted to press the opposing roller 13 against dragging roller 12. Preferably, roller 12 will be made of a certain number of cylindrical rubber lined members integrally provided on a shaft rotatably mounted, at the ends thereof, on structural parts of support 1, like for instance shoulder 7 mentioned above and a rib 7*a* on the opposite side, which supports as well the corresponding end of opposing roller 13 as it is best shown in FIG. 4. In the spaces included between said roller 12 cylindrical members, stationary tongue shaped members (not shown), or the like, may be provided in order to prevent the paper from winding back around roller 12 and to induce the paper along its regular path.

As it will be explained in more detail referring to FIG. 5, the dispensing operation is normally controlled by means of a photoelectric cell or proximity detector 6 or, in case of photocell being saturated or out of order, by means of an emergency switch such as a push button 17 placed in the front lower part of the apparatus, near the dispensing port 2*a*, and directly pressable from the outside through a suitably non-rigid portion 16 of the cover 2. This portion 16 is preferably formed as a transparent plate capable of being lit by a lamp 27, preferably red and showing a signal such as "PUSH" when the emergency switch is to be actuated for operating the dispenser. In the proximity of said push button 17 there is provided another light such as a LED 19, preferably of green colour for displaying the apparatus normal operating condition.

A substantially L-shaped metal tongue or contact 35, when the cover 2 is closed, contacts an element 36 in series with a supply circuit 22'0 having at the output an electronic switch 20 (FIG. 5) which, as will be explained later, is normally maintained to lead through the photocell 6, whereby the motor 8 is fed by activation thereof. By opening cover 2, said contact 35/36 is interrupted and the electronic switch 20 is switched to the emergency switch, whereby the dispenser motor 8 is operated only through push button 17 for safety reasons. A transformer 23, together with printed circuit boards 42, 42', is mounted within a support or fastening box 21 on the bottom of back panel 31, in order to be accessible only upon having withdrawn fastening screws 26 and after having necessarily taken the device off the supporting wall. The same holds true to gain access to the location of electrical connections 32, which is protected from the outside by means of a cover 24, still on the back side of the device.

Operations are as described in the following. Cover will have to be opened by authorized persons who are provided with an appropriate key to operate lock 5, then a new paper roll 10 to be used is placed at the inside of the device upon inserting in its central core the supporting tubular member 25, to be set, at the ends thereof, in recesses or special seats 45*a* and 45*b* of bracket members or side supports 43*a* and 43*b*. The roll 10 is manually unwound enough to insert the paper free end between dragging roller 12 and opposing roller 13 (while pushing the latter downwards in order to compress springs 15), possibly by taking advantage of motor 8, which can be actuated by means of emergency push button 17 (cover 2 is still open). Springs 15, which are now free, will bias roller 13 against roller 12, in order to provide the friction necessary to drag paper 10*a*. To that end, roller 13 will preferably be rendered rough, by any known method, according to the material thereof (wood, plastics, and so on), in particular in the central area of said roller 13, having preferably a larger diameter. In fact, the paper dragging action will be more effective in the roller central area, and in particular dragging roller 12 will comprise a number of rubber lined cylindrical areas, separate from each other, whose width size is increasing towards the center, in order to prevent the paper from contacting the rollers along the whole width thereof. This might cause the paper to curl if the paper were irregularly engaged within the roller nip. Therefore, it is preferable that friction is concentrated in a single central area corresponding to the enlarged and knurled portion of roller 13 and to the central rubber lined cylinder of roller 12, while the other cylindrical portions thereof provide more of a guiding than of a dragging action.

Figure 5:
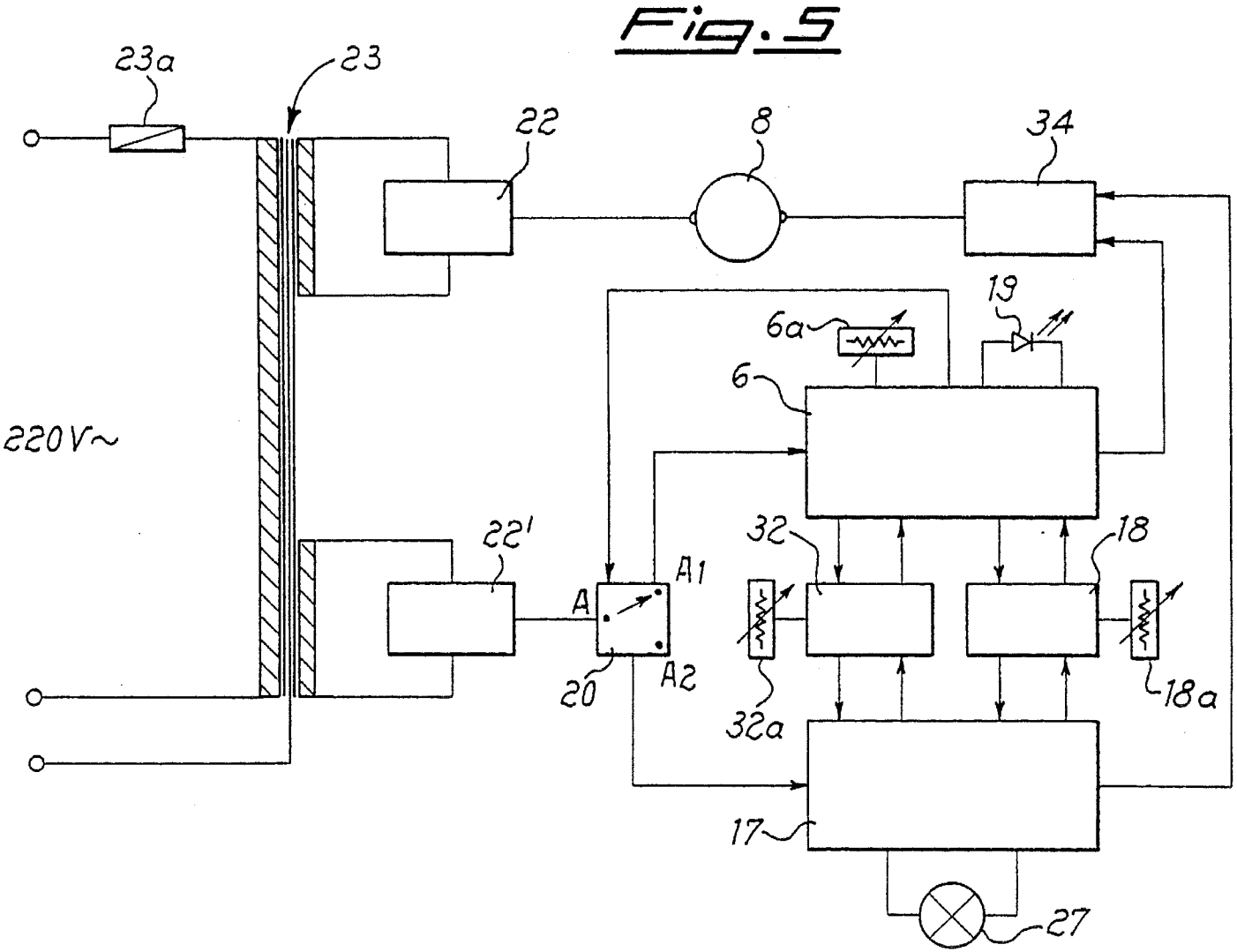
FIG. 5 is a block diagram schematic of the electrical power supply portion for actuating the apparatus.

Actuation is normally performed by enabling, with instantaneous interception by user's hand of the action area surrounding a photocell 6 placed on a side of the device (FIG. 4), the power supply to motor 8 for a predetermined time through a potentiometer or timer 18, by means of an ON-OFF circuit 34 as it is more clearly shown in the block diagram of FIG. 5, with d.c. electrical power coming from the rectified output of transformer 23. It should be noted that, instead of photocell 6, in case of its saturation or an out-of-order condition, or should the cover 2 be open and the contact 35/36 not closed, the control of power supply to motor 8 will be switched to emergency push button 17. LED 19 may be of the normally lit type, preferably of green colour to signal that the dispenser can be operated, being turned off only while the device is operating, i.e. during the entire period motor 8 is actuated and the paper is being dispensed.

The actuation time may be set on timer 18 by the service personnel only, and only after the cover has been opened to gain access to shoulder 7 carrying said control members, as well as for possible maintenance of the mechanical parts. The overall actuation time will depend upon the unrolling speed, therefore on roller 12 peripheral speed, but in any case it will be long enough to let out a flap of paper 10*a* of a sufficient length for various uses. Preferably, right after each operating cycle a "pause" period will further be provided, during which any actuation will have no result. This will be provided for instance by arranging that timer 18 may inhibit, for a predetermined time period, a new actuation of motor 8, starting from the end of an operation thereof, as will be explained in the following.

Referring now more particularly to FIG. 5, transformer 23 is shown therein as being supplied with electric power from the mains through a fuse 23*a*, with its secondary supplying separately with reduced rectified voltage (12 V d.c.) the driving motor 8 and an enable circuit for actuating said motor. The pair of d.c. supply circuits are shown at 22, 22' and are located on the printed circuit boards 42, 42' of FIGS. 2 and 4. The motor 8 is directly connected to the power supply from one side through the circuit 22, while on the other side the supply circuit can be closed on 22' by passing through two alternative paths according to the operating condition of an electronic switch 20 which is normally biased to the position A-A1, i.e. directed to the photocell 6 main circuit or first branch of the enable circuit with relevant signalling LED 19 to indicate the normal operation of the apparatus and an adjustable control 6*a* to vary the maximum distance from the cell at which it can still be activated. The already mentioned timer 18, with its associate control 18*a* for adjusting the operating time and consequently the amount of paper dispensed, as well as a pause circuit 32 (and relevant adjusting control 32*a*) are connected both at the input and at the output with the photocell 6 main circuit, in order to give the "ON" pulse to circuit 34, thus starting the motor 8 operation only upon having the consent of timer 18 and of pause circuit 32. The latter prevents timer 18 from enabling a subsequent operation, for a predetermined time period after motor 8 has stopped its operating cycle, as controlled by said timer. Therefore, after a cycle has been started, the whole time period set in the timer 18 will have to elapse (during which motor 8 is in operation and rotates dragging roller 12 which dispenses the paper) as well as the whole time period set in pause circuit 32, possibly adjustable by control 32*a*, before the next cycle can be started and the LED 19 is lit.

This prevents a subsequent activation of the photocell 6, when the motor 8 is still running or during the pause period, from providing a further "start" pulse to the motor 8 through the circuit 34. When on the contrary the photocell is caused to be permanently blind, e.g. by covering its sensor, such as by sticking any object thereon, or in case of failure thereof, or when the cover 2 is open, the electronic switch 20 is switched to the position A-A2, thus causing the enable circuit to be closed through the emergency switch (push button) 17. This second branch of the circuit provides for an alternative input to ON-OFF circuit 34, in parallel with the previously described photocell branch, and again the consent controls from timer 18 and the pause circuit 32 provide a condition for enabling operation of motor 8 upon actuation of the push button 17.

As already mentioned in the foregoing description, the signalling lamp 27, not necessarly a LED, is slit when the operation conditions are those of emergency and the photocell is inhibited. Preferably a written advice, like "PUSH" or similar is made visible by the same on the transparent plate 16, whereby the user is informed that the push button is to be operated, not the photocell 6, as the relevant LED 19 is obscure.

What is claim is:

1. An apparatus for dispensing paper towels severable from a continuous roll comprising:

a housing having a back plate, and a cover having a lower portion thereof being hingedly connected to a bottom portion of said housing, said cover including a dispensing port on the lower portion thereof;

a support for a paper roll;

a dragging roller and an opposing pressure roller for dragging a paper strip unrolled from said paper roll;

a motor for operating said dragging roller;

a cutting blade mounted in the dispensing port for severing a paper towel from the paper roll;

transmission means provided between said motor and said dragging roller, mounted on a side shoulder integral with said housing, an ON-OFF circuit for supplying power to the motor for an adjustable, predetermined time period;

a photocell for actuating said ON-OFF circuit;

an electronic switch for supplying power to said ON-OFF circuit through a first enable circuit; and an alternative enable circuit including an emergency push button in parallel with said first enable circuit to the input of said ON-OFF circuit for supplying power to the ON-OFF circuit during an emergency operating condition.

2. The dispenser of claim 1 further comprising a timer for setting the time period for supplying power to the motor, and a pause circuit for inhibiting power supplied to said motor, for an adjustable time period, said time period in which power is inhibited starting when the motor actuation has been stopped.

3. The dispenser of claim 2, wherein said timer and said pause circuit are both connected to both said first and said alternative enable circuits.

4. The dispenser of claim 2, wherein said cover is lockable by a lock to a top portion of said housing and is provided with a contact means to allow, when the cover is closed, usual operation wherein power is supplied through said first enable circuit and, when the cover is open, to cause said electronic switch to be switched to said alternative enable circuit for operation through the emergency push button.

5. The dispenser of claim 1, further comprising a transformer mounted on said back plate of the housing for supplying, at rectified reduced voltage to the motor through either one or the other of said enable circuits, said transformer and enable circuits being accessible from outside only upon removal of a support fastened to said back plate, after said dispenser has been removed from a supporting wall.

6. The dispenser of claim 1, wherein said paper roll support comprises a pair of cantilevered side members integral with the housing and having a substantially semicircular seat adapted to support the ends of a cylinder-shaped roller, the cylinder shaped roller being used as a core for said paper roll, the opposing pressure roller being mounted at the ends thereof in support plates integral with the housing, wherein springs are provided for biasing the pressure roller against said dragging roller, for maintaining a contact area between said pressure roller and said dragging roller. at least in a central area of both rollers.

7. The dispenser of claim 1, further comprising a light proximate said emergency push button, said light being lit each time said electronic switch is switched to supply power through said alternative enable circuit.

* * * * *